US006662484B1

(12) United States Patent
Andrée et al.

(10) Patent No.: US 6,662,484 B1
(45) Date of Patent: Dec. 16, 2003

(54) LOCKING DEVICE FOR WEAPONS

(76) Inventors: Reidar Andrée, Ålkärrsvägen 25, Skoghall (SE), SE-663 32; Mikael Helgesson, Jättestensgatan 13 C, Göteborg (SE), SE-418 72; Christer Eriksson, Lillahögstenavägen 4, Säve (SE), SE-423 73

( * ) Notice: Subject to any disclaimer, the term of this patent is extended or adjusted under 35 U.S.C. 154(b) by 0 days.

(21) Appl. No.: 09/831,258

(22) PCT Filed: Nov. 8, 1999

(86) PCT No.: PCT/SE99/02030

§ 371 (c)(1),
(2), (4) Date: May 8, 2001

(87) PCT Pub. No.: WO00/31491

PCT Pub. Date: Jun. 2, 2000

(30) Foreign Application Priority Data

Nov. 8, 1998 (SE) ..... 9803857

(51) Int. Cl.[7] ..... F41A 17/00

(52) U.S. Cl. ..... 42/70.11; 70/34; 70/58; 70/386; 70/408

(58) Field of Search ..... 70/386, 34, 408, 70/456 R; 42/70.11, 70.01

(56) References Cited

U.S. PATENT DOCUMENTS

| | | | | |
|---|---|---|---|---|
| 1,579,736 A | | 4/1926 | Stone | |
| 3,857,264 A | * | 12/1974 | Fowler | 70/395 |
| 4,424,693 A | | 1/1984 | Best et al. | |
| 4,742,703 A | | 5/1988 | DeWalch et al. | |
| 5,054,223 A | * | 10/1991 | Lee | 42/70.11 |
| 5,138,785 A | * | 8/1992 | Paterson | 42/66 |
| 5,209,087 A | | 5/1993 | Cox | |
| 5,279,138 A | | 1/1994 | Gallagher | |
| 5,289,653 A | * | 3/1994 | Szebeni et al. | 42/70.11 |
| 5,315,778 A | * | 5/1994 | Wolford | 102/511 |
| 5,339,663 A | | 8/1994 | Doring | |
| 5,475,994 A | * | 12/1995 | Briley et al. | 42/70.11 |
| 5,490,405 A | * | 2/1996 | Ramo et al. | 70/366 |
| 6,305,508 B1 | * | 10/2001 | Schumann | 188/72.8 |
| 6,308,450 B1 | * | 10/2001 | Ireblad et al. | 42/70.02 |
| 6,405,472 B1 | * | 6/2002 | Dojcsak | 42/70.01 |

FOREIGN PATENT DOCUMENTS

| | | |
|---|---|---|
| DE | 847416 | 8/1952 |
| DE | 899459 | 12/1953 |
| DE | 19816635 | 10/1999 |
| EP | 0942252 | 9/1999 |
| FR | 2568906 | 2/1986 |
| FR | 2590533 | 5/1987 |
| SE | 433980 | 6/1984 |
| SE | 501316 | 1/1995 |
| SE | 505705 | 9/1997 |
| SE | 510096 | 4/1999 |
| WO | 97/46847 | 12/1987 |
| WO | 89/10528 | 11/1989 |

* cited by examiner

*Primary Examiner*—Anthony Knight
*Assistant Examiner*—Christopher Boswell
(74) *Attorney, Agent, or Firm*—Dilworth & Barrese LLP.

(57) ABSTRACT

A locking device to be secured in a weapon, comprising a first locking means manoeuvrable by a lock cylinder (56), which locking means has a friction body (10) displaceably arranged in relation to the lock body (3–5) and insertable into the chamber or barrel of the weapon, and blocking elements (23) arranged to be moved into engagement with the inside wall of the chamber/barrel in case of mutual displacement between the friction body (10) and the lock body (3–5). The locking device furthermore comprising a second locking means (73), which by means of the lock cylinder (56) is movable into engagement with a space in the weapon located adjacent to the chamber/barrel in order to secure the locking device in the weapon. The invention also relates to a locking device having a ring-shaped lock element (73), a locking device comprising a lock shaft (9) with a blocking device (41) for preventing displacement of the lock shaft, a locking device comprising a blocking element and a key (2) for manoeuvring a locking device.

34 Claims, 6 Drawing Sheets

LOCKING DEVICE FOR WEAPONS

FIELD OF THE INVENTION AND PRIOR ART

The present invention relates to a locking device, preferably to be secured in the chamber or breach chamber of a weapon, and a key for co-operation with a locking device.

Weapons are frequently subjected to thefts and therefor there is a great demand for a locking device, which prevents an unauthorised person to use a stolen weapon. A locking device of this kind can be designed to block the chamber, the barrel or any other vital part of the weapon in that a lock member, comprised in the locking device, by a rotation of a lock cylinder is brought into a position, in which the locking device is secured to the weapon (this function is denominated "securing" hereinafter). The locking device can also be designed to damage any vital part of the weapon and in that way render the weapon unusable in that locking elements in the form of cutting edges, balls or the like, when attempts are being made to remove the locking device, are pressed into the material of the weapon part in question (this function is denominated "destructing" hereinafter). Locking devices with combined securing and destructing function also exist.

A locking device with a securing function is shown for instance in U.S. Pat. No. 3,765,115 A. This locking device has a lock member rotatably arranged at the front end of the locking device, which lock member is connected with a lock cylinder via a pin attached to the lock cylinder, the lock member being manoeuvrable into a securing engagement in a slot in the breach chamber of the weapon by rotation of the lock cylinder. This locking device is very easy to manipulate, since the lock member is easily accessible by boring up the lock cylinder.

A locking device with a destructing function is for instance disclosed in SE 510096 C2. This locking device comprises a friction body displaceably arranged in relation to a lock body and insertable into the barrel of the weapon, which friction body is designed to engage with an inside wall of the barrel with frictional effect at the introduction into the barrel. A number of cutting edges are arranged to be moved into engagement with the inside wall of the barrel in case of a mutual displacement between the friction body and the lock body. The locking device further comprises two blocking balls, which are movable between a blocking position, in which they engage with the friction body and prevent longitudinal displacement of the friction body in relation to the lock body, and a free position, in which they do not engage with the friction body and allow longitudinal displacement of the friction body in relation to the lock body. The locking device can be inserted into the chamber of the weapon until the friction body engages with the barrel, whereupon the blocking balls can be brought into the free position by a rotation of a lock cylinder carried out by a key. Due to the frictional engagement of the friction body with the barrel, every displacement of the lock body caused by exterior influence will now result in a relative movement between the friction body and the lock body, which in its turn causes the cutting edges to be pressed outwards towards the barrel. A further displacement of the lock body in the barrel will result in that the cutting edges will be pressed into the barrel and will render the weapon unusable. This locking device lacks a securing function.

The locking device disclosed in SE 510096 furthermore has a lock shaft rotatably and displaceably mounted in the lock body, which lock shaft is rotatably connected with the lock cylinder of the locking device and is arranged to cause said blocking balls to be placed in the desired position, i.e. locking position or free position, in connection with a rotation of the lock cylinder. The lock shaft is preloaded against the lock cylinder by means of a spring in order to prevent a gap between them. The lock shaft is accessible and easily manipulable in case someone by boring or in any other way unduly manages to remove the lock cylinder from a locking device of this kind, which is secured in a weapon. When the lock cylinder is removed, the blocking balls can then be put into the blocking position via manipulation of the lock shaft, whereupon the entire locking device can be removed without damaging the weapon.

The cutting edges of the locking device according to SE 510096 are provided with an edge having its main extension in the axial direction of the locking device and consequently the edge will produce a cut extending in the axial direction of the barrel. These edges work satisfactory in weapons having a barrel with a smooth inner surface and a relatively small thickness of material. In such weapons, the edges will be pressed into the material of the barrel, whereby they secure the locking device in the barrel so that the barrel finally, when the force exerted on the locking device becomes large enough, will be bent and deformed. Some weapons have a chamber at the rear end of the barrel. At the chamber, the material thickness is normally larger than in the rest of the barrel. It is true that a locking device having axially directed edges can cause a certain damage to the inner wall of the chamber but the relatively thick material in the chamber is able to resist the forces transferred via the locking device so well that the chamber and the barrel will not be deformed by bending. The axial cuts that are obtained in the chamber when the locking device is removed by force will not in a satisfactory manner guarantee that the weapon will become unusable.

SUMMARY OF THE INVENTION

A purpose of the present invention is to provide a locking device to be secured in a weapon, which locking device has a satisfactory destructing function as well as a satisfactory securing function.

According to the invention, this object is achieved by means of a locking device according to claim 1. In this locking device, a locking means is manoeuvrable by means of a lock cylinder comprised in the locking device into a securing engagement in a space located adjacent to the chamber or barrel of the weapon. In this locking device, a locking means having a destructing function is also manoeuvrable by means of the same lock cylinder. In the locking device according to the invention, a locking means having a destructing function is in a constructionally efficient manner combined with a locking means having a securing function, in the same time as a relatively rational and cost-effective manufacturing thereof can be achieved.

According to a preferred embodiment of the invention, a rotary motion of the lock cylinder is transferred into a movement of the second locking means via the envelope surface of a cylinder-shaped wall of the locking cylinder. In this way the locking means can be arranged at the part of the lock body that surrounds the lock cylinder, whereby the lock body can have a relatively short axial extension, which can be suitable from a security point of view since the smaller part of the locking device protruding from the space in the weapon in which the locking device is intended to be secured, the more difficult it will be to unduly manipulate the locking device.

According to a further embodiment of the invention, said rotary motion is transferred via a recess in the envelope surface of the cylinder-shaped wall. In this way a well functioning transfer of motion is achieved in a simple way, at the same time as the lock cylinder comprised in the locking device can be manufactured in a simple and cost-effective way and be easily mounted in the lock body.

A further purpose of the invention is to provide a locking device having a securing function, preferably to be secured in a weapon, which locking device has a locking means which, when the locking device is secured in a space, it is very difficult to get hold of for unduly manipulation in order to remove the locking device from said space.

According to the invention, this object is achieved by means of a locking device according to claim 8. The rotatably arranged ring-shaped lock element allows an efficient securing of the locking device in the intended space, at the same time as the lock element due to its ring-shape can be arranged at the periphery of the locking device and thereby will be very difficult to get hold of for unduly manipulation when the locking device is secured in the space.

According to a preferred embodiment of the invention, the lock element is concentric with the lock cylinder and is mounted to a section of the locking device, which section surrounds the lock cylinder. In this way the locking device can be produced with a relatively short axial extension, which makes it possible to adapt the locking device for securing in spaces having a limited extension in depth. Since the lock element of this locking device can be arranged in the vicinity of the rear end of the lock cylinder, which end is provided with a key hole, it will furthermore be possible to design the locking device in such a way that principally the entire lock cylinder is enclosed in the space, for instance a breach chamber, in which the locking device is to be secured, even when the distance between the space and the opening through which the locking device is inserted is relatively short, which makes it more difficult to unduly manipulate the locking device. With this design of the locking device, the attachment of the locking device in limited spaces is also facilitated.

A further object of the present invention is to achieve an improved security in a locking device having a rotatably and displaceably mounted lock shaft so that it will be very difficult to unduly manipulate parts of the locking device via the lock shaft, which parts co-operate with the lock shaft.

According to the invention, this object is achieved by means of a locking device according to claim 14. This arrangement of the lock shaft and the blocking device allows the lock shaft, when the lock shaft by unduly manipulation of the locking device is rendered displaceable, will be displaced a distance before it is blocked against further displacement. In this way the lock shaft can be brought out of engagement with lock parts actuatable by the lock shaft before the lock shaft comes into the blocked position, whereby these lock parts no longer can be effected by rotation of the lock shaft, at the same time as the blocked lock shaft makes it more difficult to get hold of these lock parts.

According to a preferred embodiment of the invention, the locking device has a lock cylinder comprising a cylinder-shaped wall and rotatably arranged lock discs inside the wall, an end wall of the lock cylinder, which end wall is directed towards the lock shaft, being provided with an opening for receiving an end section of the lock shaft, which opening extends up to one of the lock discs, said end section abutting against said lock disc via the opening. The lock shaft is here abutting against the lock disc preloaded via a spring element, whereby this lock disc, if the lock discs arranged in the lock cylinder will be released by unduly manipulation of the lock cylinder, will be pushed backwards under the action of the spring force transferred via the lock shaft. In this way the lock shaft will become free to be displaced under the action of said spring element into the position in which the blocking device prevents further displacement of the lock shaft.

AAccording to a further embodiment of the invention, the lock shaft is rotatable by the lock cylinder in that at least a part of the section of the end wall which delimits the opening extending through the end wall, in connection with a rotation of the lock cylinder engages with and moves the section of the lock shaft received in the opening. In this way a transfer of movement from the lock cylinder to the lock shaft is achieved in a simple way, at the same time as the section of the lock shaft received in the opening can be left free to be displaced a distance into the lock cylinder.

A further object of the invention is to provide a locking device to be inserted and secured in a space, preferably a chamber of a weapon, which it is very difficult to remove by force from said space and which can produce a great damage to the inner wall of the space in connection with attempts to remove it by force from the space.

According to the invention, this object is achieved by means of a locking device according to claim 25. With this special arrangement of the cutting edge of the blocking element, the cutting edge will produce a planing action when it engages with the inner wall of the space. During displacement along the wall the cutting edge will consequently cut material and thereby cause large damages. Since the cutting edge engages with the wall along a section of the wall surface that has a main extension in a direction forming an angle with the axial direction of the locking device, the blocking element will get a very strong hold in the wall, whereby it will be very difficult and almost impossible to remove the locking device by force when the cutting edge of the blocking element has come into engagement with the wall.

According to a preferred embodiment of the invention, the blocking element has a surface situated below the edge, from which surface the cutting edge protrudes in the axial direction of the locking device, which surface is designed to receive material cut by the cutting edge. In this way material cut by the cutting edge can be guided away from the cutting edge, whereby the material cutting ability of the cutting edge is improved.

According to a further preferred embodiment of the invention, the blocking element has a recess for receiving a ring-shaped lock element, by means of which the blocking element is secured to the locking device. In this way the blocking element is secured to the locking device in a simple way.

Locking devices intended to prevent an unauthorised person from using a weapon are often secured in the chamber of the weapon and/or in the part of the weapon that is intended to receive the forward end of a breach block comprised in the weapon. These are normally limited spaces and it can therefor be difficult to insert a locking device into this space and secure it therein, and to unlock a locking device attached in the space and remove it therefrom.

A further object of the present invention is therefor to provide a key, which is so designed that it facilitates the manoeuvring of a locking device, preferably a locking device to be secured in a weapon, in limited spaces.

According to the invention, this object is achieved by means of a key according to claim 29. By means of this key, a key blank arranged at one end of a key shaft can be rotated by rotation of a rotation means arranged at an angle to said key shaft, which facilitates the manoeuvring of a locking device arranged in a limited space.

The invention also relates to a locking device comprising such a key, which locking device further comprises a lock unit, a lock cylinder, which is rotatably arranged in the lock unit and manoeuvrable by the key blank, and a locking means, which by rotation of the lock cylinder is movable between a first position, in which the locking means allows insertion of the lock unit into and removal of the same out of a space, and a second position, in which the locking means, when the lock unit has been put in place in the space, is arranged to engage in said space for securing the lock unit therein, the key in the first position being secured to the lock unit and prevented from being released from it, and in the second position being releasable from the lock unit. In this way the key can function as an appliance for insertion of the lock unit into a space which is difficult to reach, whereby the lock unit does not have be provided with any protruding gripping parts in order to facilitate the handling thereof. When the lock unit with the aid of the key has been put in place and secured in the intended space and the key has been removed, it will therefor be very difficult to reach the lock unit and thereby difficult to unduly manipulate it.

According to the invention, the last mentioned object is also achieved by means of a key according to claim 43. By means of this key, the extractor of a weapon can be used for bringing the key and a lock unit, which might be connected to the key, into a desired position is the chamber of the weapon or in a space connected to the chamber. In this way insertion and removal of the key as well as the lock unit is facilitated.

According to a particularly preferred embodiment of the invention, the member being grippable by the extractor has a flange, which is receivable in the extractor, which flange only extends along a part of the periphery of the member so that the flange by rotation of the member can be placed in a releasing position in relation to the extractor. In this way the releasing of the key from the extractor is facilitated.

Further advantageous features of the invention are dealt with in the following description and the rest of the claims.

BRIEF DESCRIPTION OF THE DRAWINGS

With reference to the enclosed drawings, the invention will hereinbelow be more specifically described by means of embodiment examples. It is shown in.

DETAILED DESCRIPTION OF PREFERRED EMBODIMENTS

Figure 1:
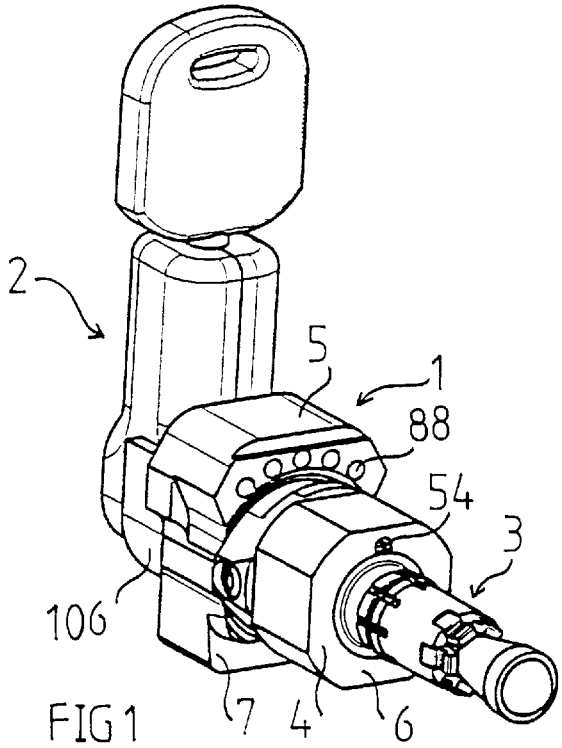
FIG. 1 in a perspective view, a locking device according to an embodiment of the invention, FIG. 2 in a sectional view, the locking device according to FIG. 1, FIG. 3 a vertical cut through the front end of the locking device according to FIG. 1, FIG. 4 a horizontal cut through the locking device part according to FIG. 3, FIG. 5 in a perspective view, the locking device part according to FIG. 4, FIG. 6 in a perspective view, a front lock body part comprised in the locking device according to FIG. 1, FIG. 7 a vertical cut through the lock body part according to FIG. 6, FIG. 8 in a perspective view, a lock shaft comprised in the locking device according to FIG. 1, FIG. 9 in a perspective view, a blocking element comprised in the locking device according to FIG. 1, FIG. 10 in a perspective view, a blocking device comprised in the locking device according to FIG. 1, FIG. 11 in a perspective view, a spring element comprised in the locking device according to FIG. 1, FIG. 12 a cut through a centre part of the locking device according to FIG. 1, FIG. 13 a cut through the centre part according to FIG. 12 with a key blank inserted into it, FIG. 14 in a perspective view, a lock cylinder comprised in the locking device according to FIG. 1, FIG. 15 in a perspective view, a central lock body part comprised in the locking device according to FIG. 1, FIG. 16 a vertical cut through the central lock body part according to FIG. 15 and a rear lock body part and a lock element connected with it, FIG. 17 a horizontal cut through the parts according to FIG. 16, FIG. 18 in a perspective view, the locking element according to FIGS. 16 and 17, FIG. 19 in a perspective view, the key unit comprised in the locking device according to FIG. 1, FIG. 20 a vertical cut through the key unit according to FIG. 19, and FIG. 21 in a perspective view, a key shaft comprised in the key unit according to FIGS. 19 and 20.
Figure 2:
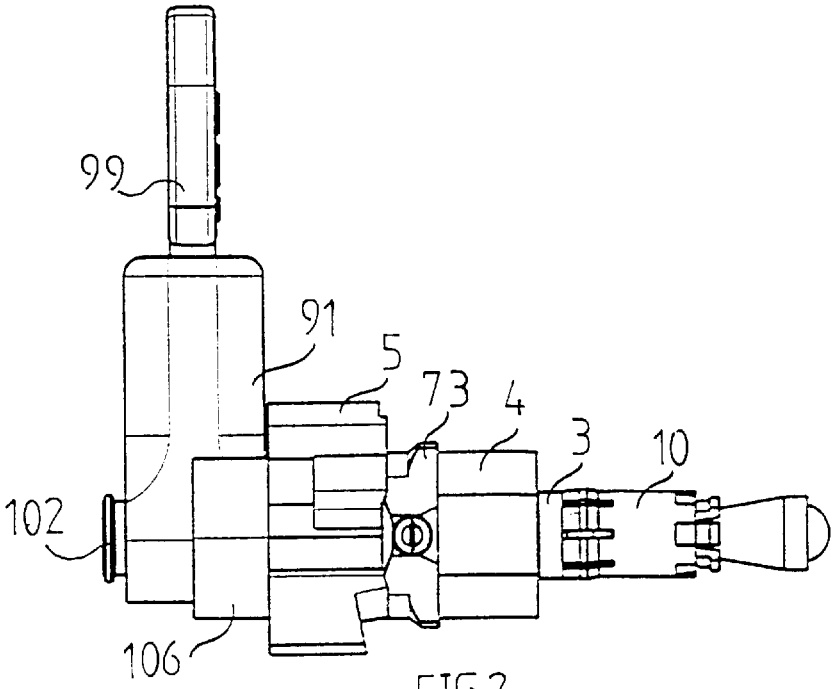

The locking device shown in FIG. 1 and FIG. 2 comprises a lock unit 1 and a key unit 2. The lock unit 1 according to the shown embodiment is adapted to be secured in a weapon of the type HK G3, but within the scope of the idea of the invention it can be modified for use also with other types of weapons. The lock unit 1 is intended to be inserted and secured in a space in the weapon, which space is designed to receive the front part of the breach block or breach block head, this space is denominated breach chamber in the following. In a weapon of the type HK G3 the breach chamber has a seat for receiving lock rolls, which lock rolls can be moved into and out of engagement with said seat in order to secure and release, respectively, the breach block head and the breach block connected to the breach block head. The lock unit 1 comprises a lock body having a front lock body part 3, a central lock body part 4 and a rear lock body part 5. The front lock body part 3 is designed for insertion into the chamber of the weapon and the central lock body part 4 is designed for insertion into the breach chamber. When the locking device has been put in place in the weapon, the front lock body part 3 is consequently situated in the chamber, whereas the central lock body part 4 is situated in the breach chamber, the front end 6 of the central lock body part 4 abutting against a front part of the breach chamber. In this position, the front end 7 of the rear lock body part 5 abuts against a section of the weapon, which section surrounds an opening leading to the breach chamber. When the lock unit 1 is in this position, it can be manoeuvred into a securing engagement with the weapon by means of the key unit 2, which will be more closely described in the following.

Figure 3:
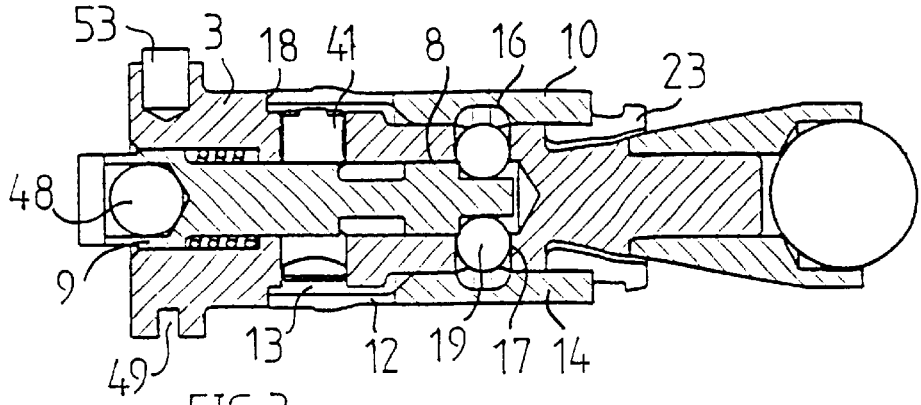
Figure 5:
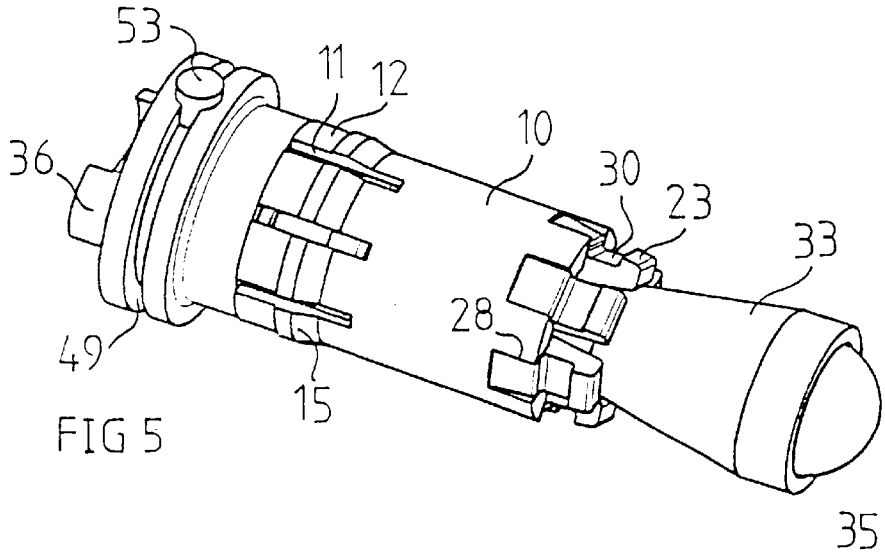
Figure 6:
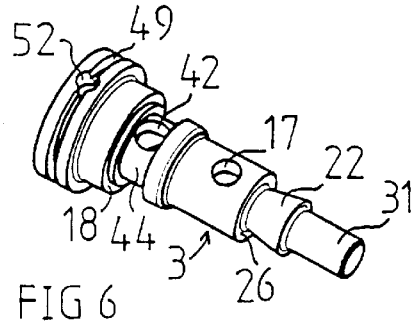
Figure 8:
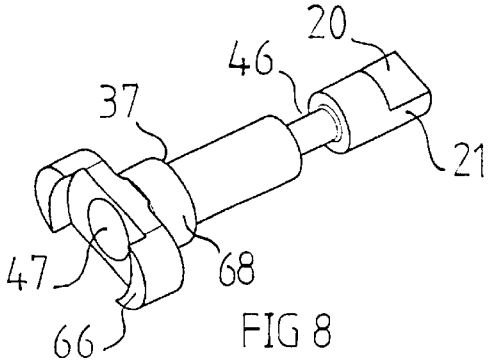
Figure 7:
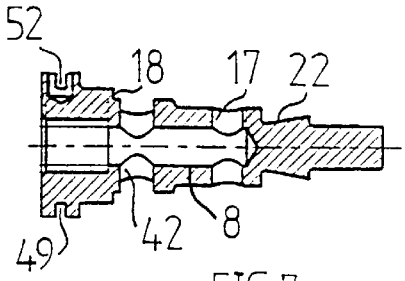

As can be seen from FIG. 3, the front lock body part 3 has an inner cavity 8, in which a lock shaft 9 is displaceably and rotatably arranged. The lock body part 3 is at its central section surrounded by a sleeve-shaped friction body 10, which is mounted to the lock body part 3. The design of this friction body clearly appears from FIG. 5. At its rear end, the friction body 10 abuts against a shoulder 18 of the lock body part 3. The friction body 10 is designed to be insertable into the chamber with friction fit and has at its rear section a number of sleeve parts 12 laterally separated by axially extending slots 11. When these sleeve parts 12 are in there unaffected state, i.e. when the front lock body part 3 is not inserted into the chamber, there is a free space 13 in the radial direction between the sleeve parts 12 and the lock body part 3. In this unaffected state, the rear slotted section of the friction body 10 has an outside diameter that is larger than the inside diameter of the chamber, whereas the front section 14 of the friction body 10 has an outside diameter that is slightly smaller than the inside diameter of the chamber. When the front lock body part 3 is displaced into the chamber, the sleeve parts 12 will consequently be pressed inwards by the inner wall of the chamber, whereby they by their own spring effect will exert a radially directed pressure force against said wall. In order to facilitate the insertion of the friction body 10 in the chamber, the sleeve parts 12 are designed with a bevel cutting 15. As an alternative to the springing sleeve parts 12, the friction body 10 could also be provided with one or several O-rings for achievement of the desired retaining frictional effect between the friction body 10 and the wall of the chamber.

The friction body 10 has a ring-shaped slot 16 at its inner surface, which slot is connected to two holes 17 arranged on opposite sides of the lock body part 3, which holes 17 extend from the outside of the lock body part and into the cavity 8. Each hole 17 is designed to receive a blocking member in the form of a blocking ball 19. These blocking balls 19 are displaceable in the holes 17 by means of the lock shaft 9, whereby they can be moved into and out of engagement with the slot 16 in the friction body 10. At its front end, the lock shaft 9 is provided with two recesses 20 for receiving the blocking balls 19, which recesses are arranged at opposite sides of the lock shaft 9. When the lock shaft 9 is in the rotary position shown in FIG. 3, the blocking balls 19 are received in the recesses 20 of the lock shaft, whereby the blocking balls 19 do not engage in the slot 16 of the friction body. Consequently, in this position a mutual axial displacement between the friction body 10 and the lock body part 3 is possible. When the lock shaft 9 is rotated 90° from the position shown in FIG. 3, the lock shaft 9 will, via the lock shaft section 21 situated between the recesses 20, press the blocking balls 19 radially outwards so that they will come into engagement with the slot 16 of the friction body. In this position, the blocking balls 19 prevent a mutual axial displacement between the friction body 10 and the lock body part 3.

Figure 4:
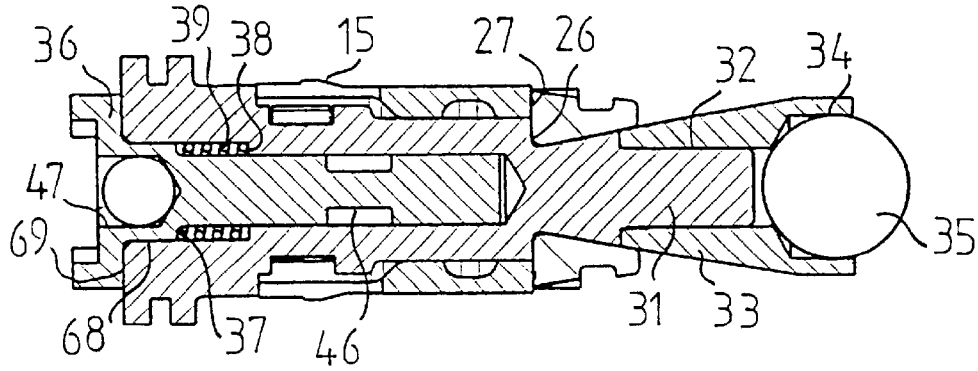
Figure 9:
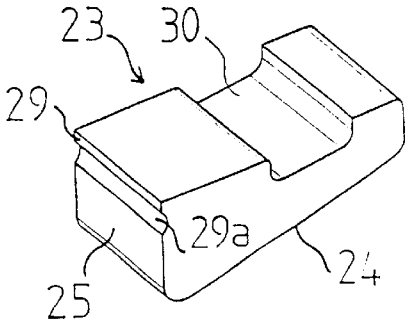

The lock body part 3 has a cone-shaped section 22 at its front end, which sections widens in the direction forwards. A number of blocking elements 23 are arranged to surround this cone-shaped section 22. The design of the blocking elements clearly appears from FIG. 9. The blocking elements ⅔ have an under-side 24, via which the blocking elements 23 slidebly abut against the cone-shaped section 22 of the lock body part. The blocking elements 23 furthermore have a rear wall 25, via which the blocking elements 23 abut against a shoulder 26 of the lock body part 3, which shoulder is arranged in connection to the cone-shaped section 22, and against the forward-directed edges 27 of the recesses 28 arranged in the front part of the friction body 10, as can be seen from FIG. 4 and FIG. 5. Each of the recesses 28 of the friction body is designed to receive the rear part of a blocking element 23 in such a way that the blocking element 23 is kept in place laterally but can be displaced in radial a direction in relation to the friction body 10. The blocking elements 23 have at their upper rear edge a cutting edge 29 extending in the cross-direction of the blocking element. A recess 29*a* extending below and along the cutting edge.29 is arranged in the rear wall 25 of the blocking element. This recess 29*a* is designed to allow removal of material cut by the cutting edge 29 when the cutting edge comes into engagement with and is displaced along the inner wall of the chamber. The blocking element 23 has at its front end a recess 30, which also extends in the cross-direction. By means of at least one rubber ring, not shown, which surrounds the lock body part 3 and is received in the slot 30 of the blocking element, the blocking element 23 is retained against the cone-shaped section 22 of the lock body part. The lock body part 3 is provided with a thread pin 31 at its front end, onto which a cone 33 having a hole with an internal thread is screwed. The envelope surface of the cone forms an extension of the cone-shaped surface 22 of the lock body part. A recess for receiving a ball 35 of hard metal material is arranged at the front end of the cone 33.

In the shown example, the cutting edges 29 of the blocking elements have their main extension in a direction being essentially perpendicular to the axial direction of the locking device, and they are consequently arranged to come into engagement with the inner surface of the chamber wall along a section of the wall surface that has a main extension in a direction being essentially perpendicular to the axial direction of the locking device. However, the cutting edge 29 could also be arranged in another angle in relation to the axial direction of the locking device. The essential thing is that the cutting edge 29 has its main extension in a direction forming an angle with the axial direction of the locking device and is arranged to come into engagement with the surface of the wall along a section of the wall surface that has a main extension in a direction forming an angle with the axial direction of the locking device. In this way, it is avoided that the blocking elements only causes simple and insufficiently destructing axial cuts in the wall of the chamber. Said angle with the axial direction of the locking device is suitably 45–90°, preferably 60–90° and particularly preferably 75–90°.

The locking shaft 9 has a rear end section 36 via which the lock shaft 9 under the action of a spring element 39 preloaded abuts against a lock cylinder 40 arranged in the central lock body part 4, which will be more closely described in the following. In the example shown, said spring element consists of a helical spring 39 arranged between a shoulder 37 of the lock shaft 9 and a shoulder 38 in the cavity 8 of the lock body part. The shoulder 37 of the lock shaft is formed by a lock shaft section 68 having a larger outside diameter than the part of the lock shaft 9 in front. The rear end section 36 is connected to this lock shaft section 68, the rear end section 36 in its turn having a larger outside diameter than the lock shaft section 68 in front. The rear end section 36 is via a front surface 69 of the same abutting against a rear end surface 70 of the lock body part 3. The rear end section 36 furthermore has a recess 47 for receiving a ball 48 of hard metal material.

Figure 11:
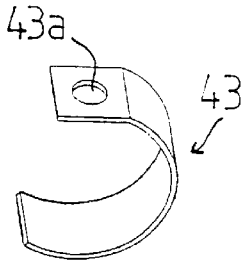
Figure 10:
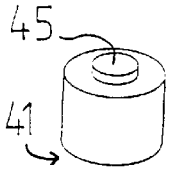

A blocking device 41 in the form of a pin is displaceably arranged in a radially directed hole 42 in the front lock body part 3. The blocking pin 41 is shown in detail in FIG. 10. In a first lock shaft position, shown in FIG. 3, the blocking pin 41 abuts under the action of a spring element 43 preloaded with its underside against the lock shaft 9 in such a way that the blocking pin 41 will not prevent an axial displacement of the lock shaft 9 in relation to the lock body part 3. In the shown example, said spring element consists of a circlip 43, which is shown in detail in FIG. 11. The circlip 43 is received in a ring-shaped slot 44 in the lock body part 3 and is retained in place against the blocking pin 41 by means of a recess 43*a* arranged in the circlip 43, which recess receives a male-shaped section 45 arranged at the upper side of the blocking pin. The lock shaft 9 has a ring-shaped slot 46 for receiving the blocking pin 41 in a second lock shaft position.

If the rear end section 36 of the lock shaft 9 is released by unduly manipulation of the locking device, the lock shaft 9 will under the action of the helical spring 39 be displaced in the direction backwards from the position shown in FIG. 3 until the slot 46 of the lock shaft ends up right before the hole 42 in the lock body part, whereupon the blocking pin under the action of the spring element 43 is pressed into the slot 46 and secures the lock shaft 9. In the latter blocked position the lock shaft 9 is prevented from axial displacement forwards as well as backwards in relation to the lock body part 3. In this position the lock shaft 9 has been displaced so far backwards from the original position shown in FIG. 3 that the forward recesses 20 of the lock shaft 9 no longer are on a level with the holes 17 of the lock body part 3, which holes receive the blocking balls 19. Therefor, the blocking balls 19 will fall towards the centre of the cavity 8 and can no longer be brought into engagement with the friction body 10 via a rotation of the lock shaft 9.

Figure 12:
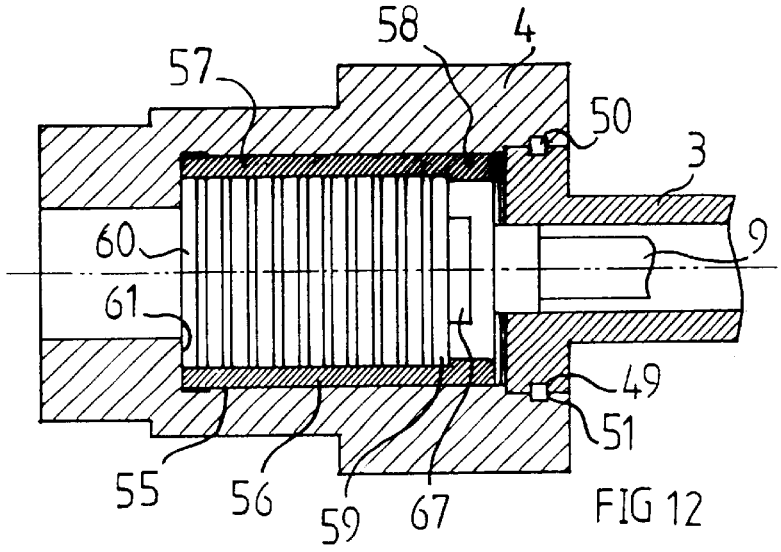

The front lock body part 3 has at its rear end a ring-shaped slot 49 for receiving a lock ring 50, which lock ring 50 by engagement with said slot 49 and a ring-shaped slot 51 arranged in the central lock body part 4 secures the front lock body part 3 to the central lock body part 4, as can be seen from FIG. 12. The rear end of the front lock body part 3 furthermore has a hole 52, within which a lock pin 53 is arranged. The lock pin 53 engages with a recess 54 arranged in the central lock body part 4 so as to prevent a rotation of the front lock body part 3 in relation to the central lock body part 4.

Figure 13:
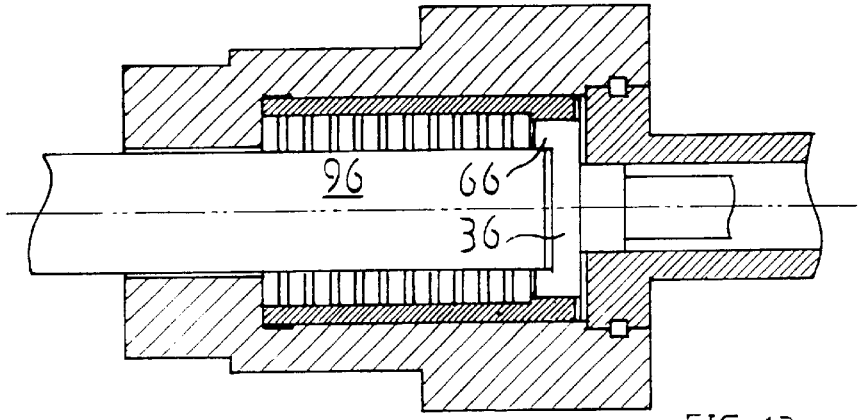
Figure 14:
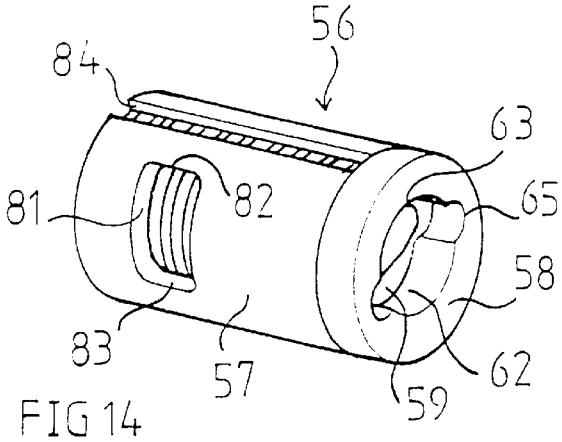

The central lock body part 4 has a cavity 55, within which a lock cylinder 56 is rotatably arranged. The lock cylinder 56 has a cylinder-shaped wall 57 and an end wall 58 arranged at the front end of the cylinder-shaped wall 57. In a cavity in the lock cylinder 56, which cavity is delimited by the cylinder-shaped wall 57 and the end wall 58, a number of lock discs are rotatably arranged. The forward lock disc 59 abuts against the end wall 58 and the rear lock disc 60 abuts, together with the rear end of the cylinder-shaped wall 57, against a shoulder 61 in the cavity 55 of the lock body part. The end wall 58 has, as can be seen from FIG. 14, an opening 62 extending through the end wall 58. The opening 62 has a circular section 63, which is designed for receiving the forward semi-circular end of a key blank 96 comprised in the key unit 2, and two "ears" 65 arranged opposite each other, which are designed for receiving two legs 66 arranged at the rear section 36 of the lock shaft and extending in an axial direction. The legs 66 extend through the opening 62 and abut with their respective rear end against the forward lock disc 59, as can be seen from FIG. 12. Via these legs 36, which are extending through the opening 62 of the end wall, the lock shaft 9 consequently abuts against the forward lock disc 59. The lock shaft 9 is herewith exerting a pressing force against this lock disc 59 under the action of the previously mentioned spring element 39. In FIG. 13, the key blank 96 is shown fully inserted into the lock cylinder 56, in which position the front end of the key blank is received in a space 67 between the two legs 66.

If the lock discs 59, 60, due to unduly manipulation of the locking device, no longer is able to resist the pressing force from the lock shaft 9, the lock shaft 9 will under the action of the spring element 39 push the lock discs backwards, i.e. to the left in FIG. 12. Consequently, the lock shaft 9 will be displaced a distance in through the opening 62 in the end wall 58 of the lock cylinder, until the lock shaft 9 ends up in the displacement position in which the blocking pin 41, as previously described, engages with the slot 46 of the lock shaft and prevents further displacement of the lock shaft 9 in relation to the lock body.

Figure 15:
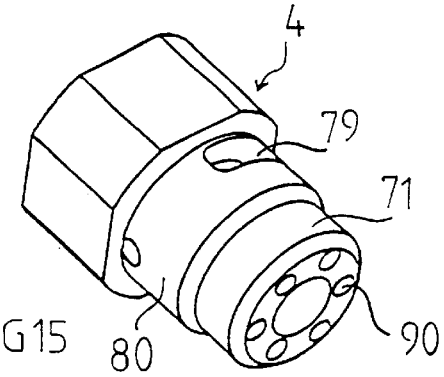
Figure 16:
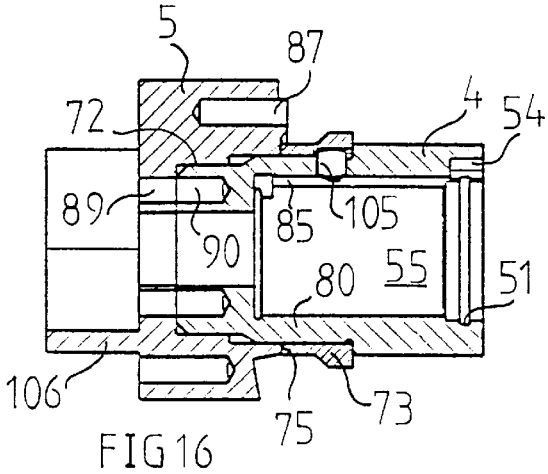
Figure 17:
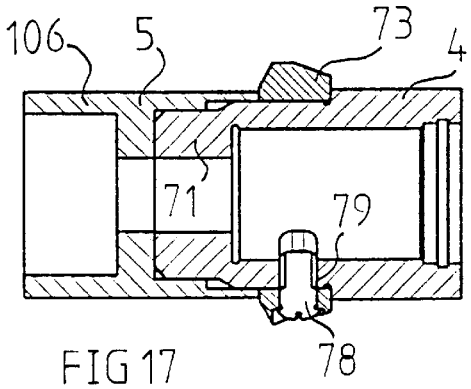

In FIG. 15, the central lock body part 4 is shown in detail in a perspective view, and in FIG. 16, the central lock body part 4 and the rear lock body part 5 connected thereto are shown in an axial cut. The central lock body part 4 has a rear cylinder-shaped section 71 provided with an external thread, via which section the central lock body part 4 is screwed into a cavity 72 in the rear lock body part 5, which cavity has an internal thread. A ring-shaped lock element 73 is rotatably mounted in such a way that it surrounds a cylinder-shaped central section 80 of the central lock body part 4. The front end of the lock element abuts against a shoulder 74 of the central lock body part 4 and its rear end abuts against a shoulder 75 of the rear lock body part 5. Consequently, these shoulders 74, 75 prevent axial displacement of the lock element 73. The design of the lock element appears in closer detail from FIG. 16. The lock element 73 has lock heads 76, 77, which in a first rotary position of the lock element 73 in relation to the lock body allow the introduction of the central lock body part 4 into the breach chamber and removal of the same therefrom, and in a second rotary position, when the central lock body part 4 is situated within the breach chamber, come into engagement with the inside surface of the breach chamber. In said second rotary position, the central lock body part 4 is, due to the engagement of the lock heads in the breach chamber, prevented from being removed and the lock unit 1 is thereby secured in the weapon.

A carrier member 78 is attached to the lock element 73. In the example shown, the carrier member consists of a threaded pin 78, which is screwed into a threaded hole in the lock element 73, as can be seen from FIG. 16. The carrier pin 78 extends into the lock cylinder 56 receiving cavity 55 via a through recess 79 in the wall of the central lock body part 4. The recess 79 has an extension along the periphery of the cylinder-shaped section 80 corresponding to approximately an eighth part of the circumference of the section plus the diameter of the carrier pin. The lower part of the carrier pin 78 protrudes into a recess 81 in the envelope surface of the cylinder-shaped wall 57 of the lock cylinder. The design of the recess appears from FIG. 14. This recess 81 has an extension along the envelope surface of the cylinder-shaped wall 57 corresponding to approximately an eighth part of the circumference of the lock cylinder plus the diameter of the carrier pin, and is delimited in the rotational direction of the lock cylinder by two edges 82, 83 of the cylinder-shaped wall. When the lock cylinder 56 is rotated, one of the edges 82, 83, depending on the direction of rotation, will engage with the carrier pin 78, which thereby during continued rotation of the lock cylinder 56 will be displaced in the recess 79 of the central lock body part until the carrier pin 78 strikes an edge of the central lock body part 4, which edge delimits the recess 79. In this way, a rotary motion of the lock cylinder 56 is consequently transferred to a rotary motion of the lock element 73 via the recess 81 of the lock cylinder and the carrier pin 78.

The cylinder-shaped wall 57 of the lock cylinder 56 has a recess 84 for receiving a not shown lock bar, which recess extends in the axial direction. The cavity 55 in the central lock body part 4, which receives the lock cylinder 56, has a corresponding slot 85 for receiving the lock bar. The lock discs 59, 60 are also provided with recesses, not shown, for receiving the lock bar. The lock bar is arranged to engage with the lock cylinder 56 and the central lock body part 4 via the axial recess 84 and slot 85 in a first position, so as to prevent rotation between them. In a second position, in which the lock discs 59, 60 have been rotated so that their recesses are situated right in front of the slot 85, the lock bar will fall into the recesses of the lock discs and escape from the slot 85, whereupon a rotation of the lock cylinder 56 in relation to the central lock body part 4 is made possible.

Figure 18:
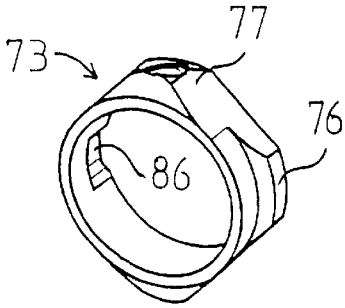

A lock pin, not shown, is movably arranged within a hole 105 in the central lock body part 4. The hole 105 is connected to the slot 85 in the cavity 55 and to the lock element 73. When the lock bar is within the slot 85, it will press the lock pin radially outwards so that the outer end of the lock pin protrudes into a recess 86 arranged in the inner surface of the lock element (see FIG. 18). In this position, the lock pin consequently prevents a rotation of the lock element 73 in relation to the central lock body part 4.

The rear lock body part 5 has a number of holes 87, as can be seen from FIG. 16. Rods 88 of hard metal, see FIG. 1, is inserted into these holes 87 in order to make it difficult to bore up the lock unit 1. The rear lock body part 5 also has a number of holes 89, which connects to corresponding holes 90 in the central lock body part 4. Rods of hard metal, not shown, are also inserted into these holes 89, 90 in order to make it difficult to bore up the lock unit 1.

Figure 19:
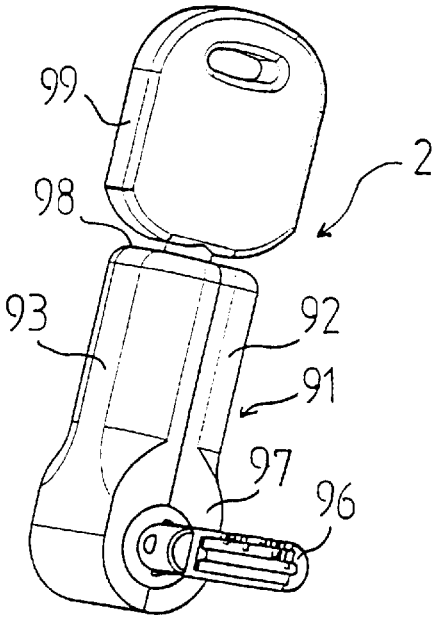
Figure 20:
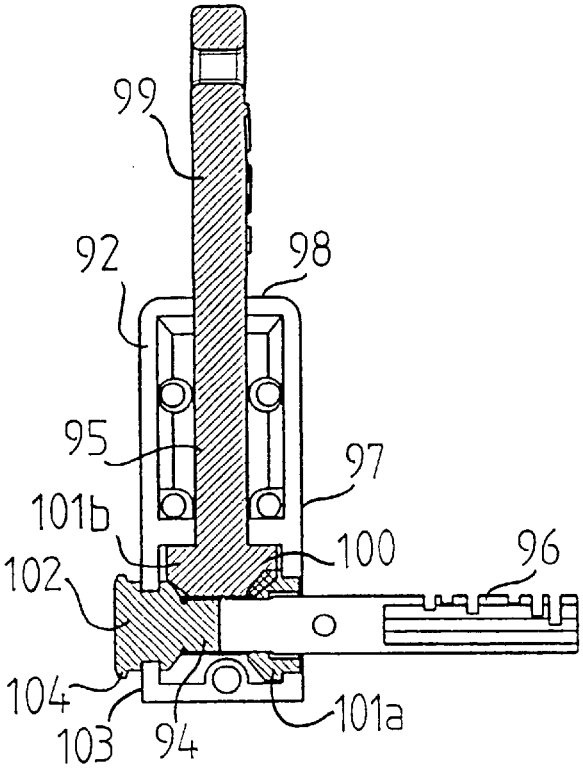

The key unit 2 shown in FIGS. 19 and 20 comprises a key casing 91 consisting of two halves 92, 93 joined with each other. In the key casing 91 a first key shaft 94 is rotatably mounted, in the front end of which a key blank 96 is arranged, which key blank 96 protrudes from a front side wall 97 of the key casing 91. A second key shaft 95 is rotatably mounted in the key casing 91 at a right angle in relation to the first key shaft 94. At an upper part of the second key shaft 95, which part protrudes from an upper wall 98 of the key casing 91, a rotation means in the form of a handle is arranged, by means of which the second key shaft 95 can be rotated about its central axis. The key unit furthermore comprises a coupling device in the form of a bevel gearing 100 for transferring a rotary motion from the second key shaft 95 to the first key shaft 94. The gearing 100 comprises a cone-shaped gearing part 101a rotatably connected with the first key shaft 94, via which gear part the first key shaft 94 is mounted at the forward side wall 97 of the key casing 91, and a second cone-shaped gearing part 101*b* rotatably connected with the second key shaft 95, which gearing part is arranged at the lower end of the second key shaft 95.

The key unit 2 furthermore comprises a member 102 accessible from the exterior of the key casing, via which member a pulling force or a pushing force can be transferred to the key unit 1 for pulling the key unit 1 backwards and pushing the key unit 1 forwards, respectively, in a direction essentially parallel with the central axis of the first key shaft. In the example shown, the member consists of a pin 102 protruding from the rear side wall 103 of the key casing 91. This pin 102 is concentric with the first key shaft 94 and is rotatably connected to this. The pin 102 has a radially protruding flange 104, which has a shape corresponding to the cartridge flange of the cartridges that are intended for the weapon in question. Consequently, the extractor of the weapon is able to grip hold of the pin 102 via the flange 104, whereby a pulling or pushing force exerted by the extractor can be transferred to the pin 102 for pulling the key unit 1 backwards and pushing the key unit 1 forwards, respectively.

Figure 21:
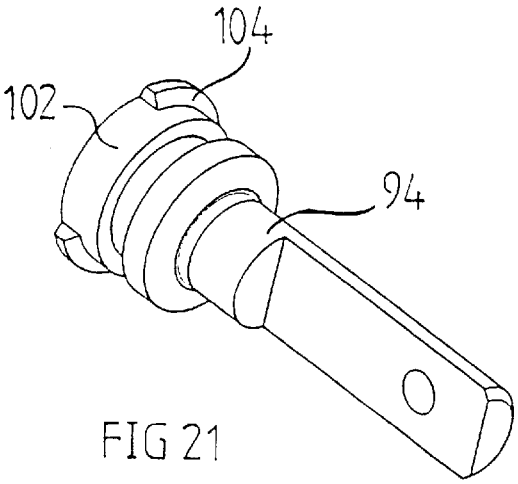

In FIG. 21 the first key shaft 94 is shown in detail with the pin 102 arranged at the rear end of the key shaft. As can be seen from FIG. 21, the flange 104 of the pin only extends along a part of the periphery of the pin so that the flange 104 by rotation of the pin 102 can be placed in a releasing position or gripping position in relation to the extractor.

The locking device shown in FIG. 1 and FIG. 2 is designed in such a way that the key unit 2 only can be released from the lock unit 1 when the lock element 73 by means of the lock unit 2 has been rotated to its securing position. Consequently, the key unit 2 is, by the engagement of the key blank 96 with the lock discs 59, 60 in the lock cylinder 56, secured to the lock unit 1 when the lock unit is to be put in place in the breach chamber of the weapon. In this way the key unit 2 can be used as a handle in order to facilitate the handling of the lock unit 1. The rear lock body part 5 has a U-shaped flange 106, which is designed to receive the lower part of the key casing 91 when the key blank 96 is inserted into the lock cylinder 56. In this way a rotation of the key casing 91 in relation to the lock unit 1 is prevented. When the lower part of the lock unit has been inserted some distance into the breach chamber, the extractor of the weapon is pushed forward and the extractor grips hold of the pin 102 protruding irom the key casing 91. By means of the extractor, the lock unit 1 can now be pushed forwards to the previously described position, in which the front lock body part 3 is situated within the chamber, whereas the central lock body part 4 is situated wiithin the breach chamber and the front end 6 of the central lock body part 4 abuts against a front section of the breach chamber. In this position the front end 7 of the rear lock body part 5 abuts against a section of the weapon, which surrounds an opening leading to the breach chamber. At this stage of insertion, the blocking balls 19 engage in the slot 16 of the friction body and consequently prevent a displacement of the friction body in relation to the front lock body part 3. When the lock unit 1 thus has been put in place in the weapon, the key blank 96 is rotated by means of the rotation handle 99 so that the lock cylinder 56 will be rotated. The rotation of the lock cylinder 56 is transferred to the lock shaft 9 in that the section of the end wall 58 of the lock cylinder, which section delimits the "ears" 65 of the opening 62 extending through the end wall 58, in connection with the rotation of the lock cylinder 56 engages with and carries the legs 66 of the lock shaft with it. By rotation of the lock cylinder a forth part of a revolution, the lock shaft will be placed in the position shown in FIG. 3, in which the blocking balls 19 are received in the recess 20 of the lock shaft, the friction body 10 no longer being blocked from displacement in relation to the front lock body part 3. The friction body 10 then engages with frictional effect with the inside wall of the chamber of the weapon, as previously described.

The ring-shaped lock element 73 is also effected by said rotation of the lock cylinder 56. The recesses 79, 81 in the central lock body part 4 and lock cylinder 56 are arranged in such a way that one of the edges 82, 83, which delimits the recess 81 of the lock cylinder, will come into engagement with the carrier pin 78 only after a rotation of the lock cylinder 56 an eighth part of a revolution from the original position. During rotation of the lock cylinder 56 a further eighth part of a revolution, the lock element 73 will move along in the rotary motion. When the lock cylinder 56 thus has been rotated a forth part of a revolution from the original position, the carrier pin 78 will strike one of the edges of the recess 79 in the central lock body part, and the lock heads 76, 77 of the lock element have been placed in the position in which they come into engagement with the inner surface of the breach chamber. In this rotary position of the lock cylinder 56, the lock bar has been placed in its blocking position in the recess 84 in the lock cylinder and in the slot 85 in the central lock body part, the lock pin protruding into the inner recess 86 in the lock element as previously mentioned. Consequently, a rotation of the lock element 73 is prevented by the lock pin as well as the lock bar, by preventing rotation of the lock cylinder 56 the lock bar also prevents rotation of the lock element 73.

When the lock cylinder 56 is rotated a forth part of a revolution, the lock shaft 9 is consequently rotated a forth part of a revolution at the same time as the lock element 73 is rotated an eighth part of a revolution.

In this position, when the lock unit 1 is secured in the weapon, the key blank 96 can be released from the lock cylinder 56 and the key unit 2 can consequently be removed. This is carried out in that the extractor is moved backwards and, through its engagement with the pin 102 of the key unit, pulls the key unit 2 backwards out of the lock unit 1. When the key unit 2 has thus been moved out of engagement with the lock unit 1, it is released from the extractor in the same way as a cartridge extracted by the extractor is released from it.

In this locking position, the lock heads 76, 77 consequently prevent an unduly removal of the lock unit 1 from the weapon. Due to the ring-shape of the lock element, it is very difficult to get hold of the lock element 73 for instance by boring attempts from behind via the rear lock body part 5. A boring up of the lock unit 1 is obstructed by the hard metal rods 88 arranged in the central and rear lock body part 4, 5. As mentioned above, the friction body 10 now engages with frictional effect with the inside wall of the chamber of the weapon. Since the friction body 10 furthermore is displaceable in relation to the front lock body part 3, any attempt to pull out the lock unit from behind or push out the lock unit from the front will result in that the front lock body part 3 will be displaced in relation to the friction body 10. The blocking elements 23 will then be pressed forwards along the cone-shaped surface 22, 33 and they will be pressed radially outwards against the inner surface of the chamber by this cone-shaped surface. In case of a further displacement backwards of the front lock body part 3, the cutting edges 29 of the blocking elements will cut into the inside wall of the chamber and obstruct the removal of the lock unit 1. Since each cutting edge 29 will come into engagement with the surface of the wall along a section of the wall surface that has a main extension in a direction being essentially perpendicular to the axial direction of the lock unit, the blocking elements 23 will obtain a very good grip in the wall, wherefor it will be extremely difficult to remove the lock unit 1. If the lock unit is subjected to a very strong pulling/pushing force, the cutting edges 29 will destroy the inside wall of the chamber by planning and will make the weapon unusable. The friction body 10 and the blocking elements 23 consequently constitute a destructing secondary locking function, which comes into operation in case someone manages to manipulate the lock unit 1 so that the securing effect of the lock element 73 ceases.

If someone manages to bore up the lock cylinder 56, the previously described blocking function of the lock shaft 9 comes into operation. The metal balls 35, 48 of the cone and the lock shaft, respectively, contribute in obstructing a boring up of the lock unit 1.

When the lock unit 1 is to be removed, the key unit 2 is placed in front of the lock unit 1 with the key casing 91 abutting against the U-shaped flange 106 and the key blank 96 is inserted into the key hole. The extractor is thereafter moved forwards against the pin 102 of the key unit 2. The lock cylinder 56 can now be rotated back a forth part of a revolution to the original position. The lock shaft 9 will then be rotated a forth part of a revolution, and the blocking balls 19 will be pressed outwards so that they come into engagement with the slot 16 in the friction body. The blocking balls 19 now prevent a displacement of the friction body 10 in relation to the front lock body part 3, and therefor the lock unit 1 can be pulled backwards without the blocking elements 23 being effected. At the same time, the ring-shaped lock element 73 will in the way described above be rotated an eighth part of a revolution and end up in the original position, in which the lock unit 1 is free to be pulled out of the breach chamber. The extractor is now moved backwards and pulls the lock unit 1 out of the breach chamber by its engagement with the pin 102. By rotation of the rotation handle 99 of the key unit, the pin 102 is now rotated some distance so that the flange 104 of the pin is moved to the position in relation to the extractor in which the flange 104 is released from the extractor. Thereafter, the locking device thus released can be lifted away.

A blocking device for preventing a displacement of the lock shaft could, as an alternative to the shown example, be arranged in a space in the lock shaft and by means of a spring element arranged in the space preloadedly abut against the inside wall of a lock shaft receiving space in the locking device. The blocking device could in this case be arranged to, when the lock shaft has been displaced a certain distance, come into engagement with a slot or recess arranged in the lock shaft receiving space so as to prevent a further displacement of the lock shaft.

The ring-shaped lock element 73 comprised in the shown example could also be included in a locking device lacking the lock parts described in connection with FIGS. 3–11. Such a locking device could of course also be designed to be secured at another object than a weapon. Furthermore, the key unit 2 described above could be adapted for use with other types of locking devices than the one according to the shown example. The invention is neither as to the rest limited to the described embodiment, on the contrary a number of modifications thereof are possible within the scope of the subsequent claims.

What is claimed is:

1. A locking device to be secured in a weapon, comprising a lock body (3–5), a lock cylinder (56) rotatably arranged in the lock body (3–5) and a locking means, which locking means has a friction body (10) displaceably arranged in relation to the lock body (3–5) and insertable into the chamber or barrel of the weapon, which friction body is designed to engage with an inside wall of the chamber/barrel with frictional effect at the insertion into the chamber/barrel, and at least one blocking element (23) arranged to be moved into engagement with the inside wall of the chamber/barrel in case of a mutual displacement between the friction body (10) and the lock body (3–5), the locking device furthermore comprising a blocking member (19), which by means of the lock cylinder (56) is moveable between a blocking position, in which the blocking member (19) engages with the friction body (10) and prevents longitudinal displacement of the friction body (10) in relation to the lock body (3–5), and a free position, in which the blocking member (19) does not engage with the friction body (10) and allow longitudinal displacement of the friction body (10) in relation to the lock body (3–5), characterized in that the locking device in addition to the first locking means comprises a second locking means (73), which by means of the lock cylinder

(56) is movable between a first position, corresponding to the blocking position of the blocking member, in which the second locking means (73) allows insertion of the locking device into and removal of the same out of a space in the weapon located adjacent to the chamber/barrel, and a second position, corresponding to the free position of the blocking member, in which the second locking means, when the locking device has been put in place in the weapon with the lock body (3–5) extending into the chamber/barrel, is arranged to engage in said space for securing of the locking device in the weapon.

2. A locking device according to claim 1, characterized in that the lock cylinder (56) comprises a cylinder-shaped wall (57) and that a means is arranged to transfer a rotary motion of the lock cylinder (56) into a movement of the second locking means (73) via an envelope surface of the cylinder-shaped wall.

3. A locking device according to claim 2, characterized in that the means comprises a recess (81) arranged in the envelope surface of the cylinder-shaped wall (57).

4. A locking device according to claim 3, characterized in that the second locking means (73) is connected with a carrier member (78) extending down into the recess (81) in the cylinder-shaped wall (57), the carrier member (78) being arranged to be displaced in connection with a rotation of the lock cylinder (56), by an edge (82,83) of the cylinder-shaped wall (57), which edge delimits the recess (81).

5. A locking device according to claim 4, characterized in that the carrier member consists of a pin (78), which is attached to the second locking means.

6. A locking device according to claim 1, characterized in that the second locking means comprises a ring-shaped lock element (73) rotatably mounted to the lock body (3–5), which ring-shaped lock element (73) has at least one section (76,77) which by rotation of the lock element (73) can be brought into or out of engagement with a section of said space.

7. A locking device according to claim 6, characterized in that the ring-shaped lock element (73) is concentric with the lock cylinder (56) and is mounted at a section (80) of the lock body (3–5), which section surrounds the lock cylinder (56).

8. The locking device of claim 1, wherein said second locking means (73) are concentrically positioned around a central lock body part (4) having a cavity (55) in which the lock cylinder (56) is rotatably positioned.

9. A locking device according to claim 1, characterized in that the second locking means (73) comprises a rotatably arranged ring-shaped lock element (73) having at least one section (76,77) which by rotation of the lock element (73) can be brought into or out of a securing engagement with a section of said space.

10. A locking device according to claim 9, characterized in that the lock element (73) is concentric with the lock cylinder (56) and is mounted to a section (80) of the locking device, which section surrounds the lock cylinder (56).

11. A locking device according to claim 10, characterized in that the lock cylinder (56) has a cylinder-shaped wall (57), and that a rotary motion of the lock cylinder (56) is transferred into a rotary motion of the lock element (73) via a recess (81) arranged in an envelope surface of the cylinder-shaped wall (57).

12. A locking device according to claim 11, characterized in that the lock element (73) is connected with a carrier member (78) extending down into the recess (81) in the cylinder shaped wall (57), the carrier member (78) being arranged to be displaced, in connection with rotation of the lock cylinder (56), by an edge (82,83) of the cylinder-shaped wall (57), which edge delimits the recess (81).

13. A locking device according to claim 12, characterized in that the carrier member consists of a pin (78), which is attached to the lock element (73).

14. A locking device according to claim 9, characterized in that a cavity (55), which receives the lock cylinder (56), has a slot (85) for receiving a lock bar, which slot extends in an axial direction, that a lock pin is movably arranged within a space (105) in the locking device, which space (105) is connected to the slot (85) of the lock body and to the lock element (73), the lock pin is being displacable by the lock bar into engagement with a recess (86), which recess is arranged in the lock element (73) so as to prevent rotation of the lock element (73) when the lock bar is inside the slot (85).

15. A locking device comprising a lock body (3–5) and a lock cylinder (56) rotationally arranged in the lock body (3–5), the lock cylinder (56) comprising a cylinder-shaped wall (57), an end wall (58) arranged at one end of the lock cylinder (56) and lock discs (59,60) rotatably arranged inside the cylinder-shaped wall (57), the locking device further comprising a lock shaft (9) arranged in the lock body (3–5), which lock shaft (9) is rotatable around its central axis in relation to the lock body (3–5) by means of the lock cylinder (56), characterized in that the lock shaft (9) is arranged under the action of a first spring element (39), to abut against one of the lock discs (59) via an opening (62) provided in the end wall (58) of the lock cylinder (56) so as to be displaced towards the lock cylinder (56) in case the supporting action from said lock disc (59) ceases, and that the locking device further comprises at least one movably arranged blocking device (41), which under the action of a second spring element (43), when a displacement of the lock shaft (9) towards the lock cylinder (56) takes place, is arranged to be displaced to a position in which the blocking device (41) prevents further displacement of the lock shaft (9) towards or away from the lock cylinder (56).

16. A locking device according to claim 15, characterized in that blocking device consists of a pin (41).

17. A locking device according to claim 15, characterized in that the blocking device (41) in its position of blocking the movement of the lock shaft (9) engages with a slot (46) or recess arranged in the lock shaft (9).

18. A locking device according to claim 17, characterized in that the blocking device (41) is preloaded against the lock shaft (9) by means of the second spring element (43).

19. A locking device according to claim 15, characterized in that the blocking device (41) is arranged in the lock shaft (9) and in the second position engages with a slot or recess arranged in a space in the locking device, which space receives the lock shaft (9).

20. A locking device according to claim 19, characterized in that the blocking device (41) is preloaded against the inner wall of the space by means of the second spring element.

21. A locking device according to claim 15, characterized in that the locking device comprises a friction body (10), which is displacable in the longitudinal direction of the lock shaft and a blocking member (19) actuable by the lock shaft (9), which blocking member (19) by rotation of the lock shaft (9) is maneuverable between a first rotary position, in which the blocking member (19) engages with the friction body (10) and prevents a displacement of the friction body (10) in the longitudinal direction of the lock shaft, and a second rotary position, in which the friction body (10) is displaceably moveable in the longitudinal direction of the lock shaft, the lock shaft (9) in the second position being prevented from affecting the blocking member (19).

22. The locking device of claim 15, wherein said locking discs (59,60) are positioned at opposite axial ends of said lock cylinder (56).

23. A key for maneuvering a locking device to be secured in a weapon, characterized in that the key (2) comprises a member (102) designed to be grippable by an extractor of the weapon, whereby a pulling or pushing force exerted by the extractor can be transferred to the member (102) for pulling the key (2) backwards and pushing the key (2) forwards, respectively, wherein the member (102) has a flange (104) which is structured and arranged to be receivable in the extractor.

24. A key according to claim 23, wherein the key comprises a key blank (96) intended for co-operation with a lock cylinder, a key casing (91) and a first key shaft (94) rotatably mounted in the key casing (91), in the front end of which shaft (94) the key blank (96) is arranged, and a second key shaft (95) rotatably mounted in the key casing (91), the first and second key shafts (94,95) being arranged at an angle in relation to each other, a coupling device (100) being arranged in the key casing (91) for transferring rotary motion from the second key shaft (95) to the first key shaft (94), and the second key shaft being rotatable by rotation means (99) connected to the second key shaft (95).

25. A key according to claim 24, characterized in that the first and second key shafts (94,95) are arranged at a right angle to each other.

26. A key according to claim 24, characterized in that the coupling device consists of a bevel gearing (100).

27. A key according to claim 24, characterized in that the member (102) is concentric with the first key shaft (94).

28. A key according to claim 27, characterized in that the member (102) is attached at the rear end of the first key shaft (94).

29. A locking device, characterized in that it comprises a key (2) according to claim 24, which locking device furthermore comprises a lock unit (1), a lock cylinder (56), which is rotatably arranged in the lock unit (1) and maneuverable by the key blank (96), and a locking means (73), which by rotation of the lock cylinder (56) is movable between a first position, in which the locking means (73) allow insertion of the lock unit (1) into and removal of the same out of a space, and a second position, in which the locking means (73), when the lock unit (1) has been put in place in the space, is arranged to engage in said space for securing the lock unit (1) therein, and that the key (2) in the first position is secured to the lock unit (1) and prevented from being released from it, and in the second position is releasable from the lock unit (1).

30. A locking device according to claim 29, characterized in that the lock unit (1) has means (106) for preventing the key casing (91) from rotating in relation to the lock unit (1) when the key (2) is secured to the lock unit.

31. A key according to claim 24, characterized in that the member (102) is rotatably connected to the first key shaft (94).

32. A key according to claim 24, characterized in that the member (102) protrudes from a rear wall (103) of the key casing (91).

33. A key according to claim 23, characterized in that the flange (104) only extends along a part of the periphery of the member so that the flange (104) by rotation of the member (102) can be placed in a releasing position in relation to the extractor.

34. A key according to claim 23, characterized in that the member (102) is formed as a pin.

* * * * *